United States Patent [19]

Droege, Sr. et al.

[11] 3,961,868

[45] June 8, 1976

[54] AIR COMPRESSOR

[75] Inventors: Arthur John Droege, Sr.; Richard Charles Bell, both of Sheboygan, Wis.

[73] Assignee: Thomas Industries, Inc., Sheboygan, Wis.

[22] Filed: Feb. 21, 1974

[21] Appl. No.: 444,472

[52] U.S. Cl. ..... 417/550; 92/240; 92/155

[51] Int. Cl.[2] ..... F04B 39/10

[58] Field of Search ..... 417/550, 566; 92/240, 92/246, 155

[56] References Cited

UNITED STATES PATENTS

| | | | |
|---|---|---|---|
| 1,003,200 | 9/1911 | Peters | 417/550 |
| 1,470,548 | 10/1923 | Spohrer | 417/550 |
| 1,517,489 | 12/1924 | Barwood | 92/240 |
| 1,635,615 | 7/1927 | Green | 417/490 |
| 1,883,328 | 10/1932 | Bihl et al. | 417/490 |
| 2,265,971 | 12/1941 | Paul et al. | 92/240 |
| 2,463,766 | 3/1949 | Habley | 417/566 |
| 2,691,558 | 10/1954 | Smith | 92/246 |
| 2,792,790 | 5/1957 | Capps | 417/550 |
| 2,836,474 | 5/1958 | Mosher | 92/240 |
| 2,842,284 | 7/1958 | Flick | 92/169 |
| 2,963,217 | 12/1960 | Wysong, Jr. | 92/169 |
| 2,985,358 | 5/1961 | Lee et al. | 92/240 |
| 3,004,810 | 10/1961 | King | 417/550 |
| 3,331,328 | 7/1967 | Smith et al. | 417/415 |
| 3,388,638 | 6/1968 | Brinkel | 92/240 |
| 3,628,427 | 12/1971 | Bailey | 92/144 |
| 3,716,310 | 2/1973 | Guenther | 417/552 |

FOREIGN PATENTS OR APPLICATIONS

| | | | |
|---|---|---|---|
| 604,894 | 9/1960 | Canada | 417/550 |
| 1,263,810 | 5/1961 | France | 92/240 |

*Primary Examiner*—William L. Freeh

*Attorney, Agent, or Firm*—Johnson, Dienner, Emrich, Wagner

[57] ABSTRACT

A small high speed direct connected motor compressor has a unitary piston and piston rod whereby the piston wobbles in the cylinder as the crank shaft rotates. The wobbling piston is sealed to the cylinder by a flanged disk of Teflon which forms both a seal and mechanical guide for the piston and which runs without lubrication in contact with a low-friction, surface-coated cylinder of high heat conductivity. The circular rim of the Teflon cup is warped from circular outline to elliptical outline twice per revolution while maintaining its seal with the walls of the cylinder. The structure involves small clearance spaces with consequent good efficiency.

1 Claim, 6 Drawing Figures

AIR COMPRESSOR

BACKGROUND OF THE INVENTION

There is a demand for an air compressor for supplying relatively small—sometimes continuous—quantities of compressed air or other gas for services which are more or less mobile such as trucks, busses, mobile homes, etc. where the motive power is derived from the electrical system of a vehicle or other point of non-availability of central power. A compressor for such service can expect little or no service attention, must operate without lubrication, receives no adjustments, and be reliable and efficient. The art has made numerous attempts to utilize the wobbling piston, but designs heretofore have involved requirements of costly and fragile accuracy and which, under the temperatures which may be developed in devices of this character, are not sufficiently rugged to meet the requirements of the market.

SUMMARY OF THE INVENTION

The compressor of this invention employs a wobbling piston in which the seal between the piston and the cylinder wall is a unitary flanged Teflon disk or cup of a thickness—for small size compressors—in the neighborhood of 0.03 inch. This flanged Teflon disk performs two functions. First, it serves as a guide for guiding the piston in the cylinder bore and, second, it serves as a pneumatic seal for the piston to the walls of the cylinder. The Teflon seal bears against an aluminum wall having an anodic coating with a high hardness surface of low friction with the Teflon seal with consequent low heat loss due to friction even though no lubrication be utilized. The design of the passageways and valves involves minimum friction of flow fluid and minimum clearance spaces in going from atmospheric to discharge pressure through the compressor. The compressor has an operating shaft with a crank but utilizes no wrist pin and depends upon guidance of the piston in the cylinder by the Teflon flange of the shaped Teflon disk. The piston moves from its topmost position where it is cylindrical and coaxial with the cylinder through a tilting action to its lowermost point where the piston is again aligned axially with respect to the axis of the cylinder so that the flange has passed from cylindrical to elliptical and back again to cylindrical but maintaining a fluid tight fit on both the downward and upward stroke, which upward stroke performs the action of compression of the gas trapped above it. At the top of the stroke, the flat top of the piston and the flat bottom of the cylinder head minimize clearance and thereby give good volumetric efficiency.

OBJECTS OF THE INVENTION

The chief object of the invention is to provide a low cost compressor of high efficiency and long life and requiring a minimum of service.

A further object is to produce an efficient long life compressor that requires no lubrication.

DESCRIPTION OF THE PREFERRED EMBODIMENT

Figures 1, 2, 3, 4, 5, 6:
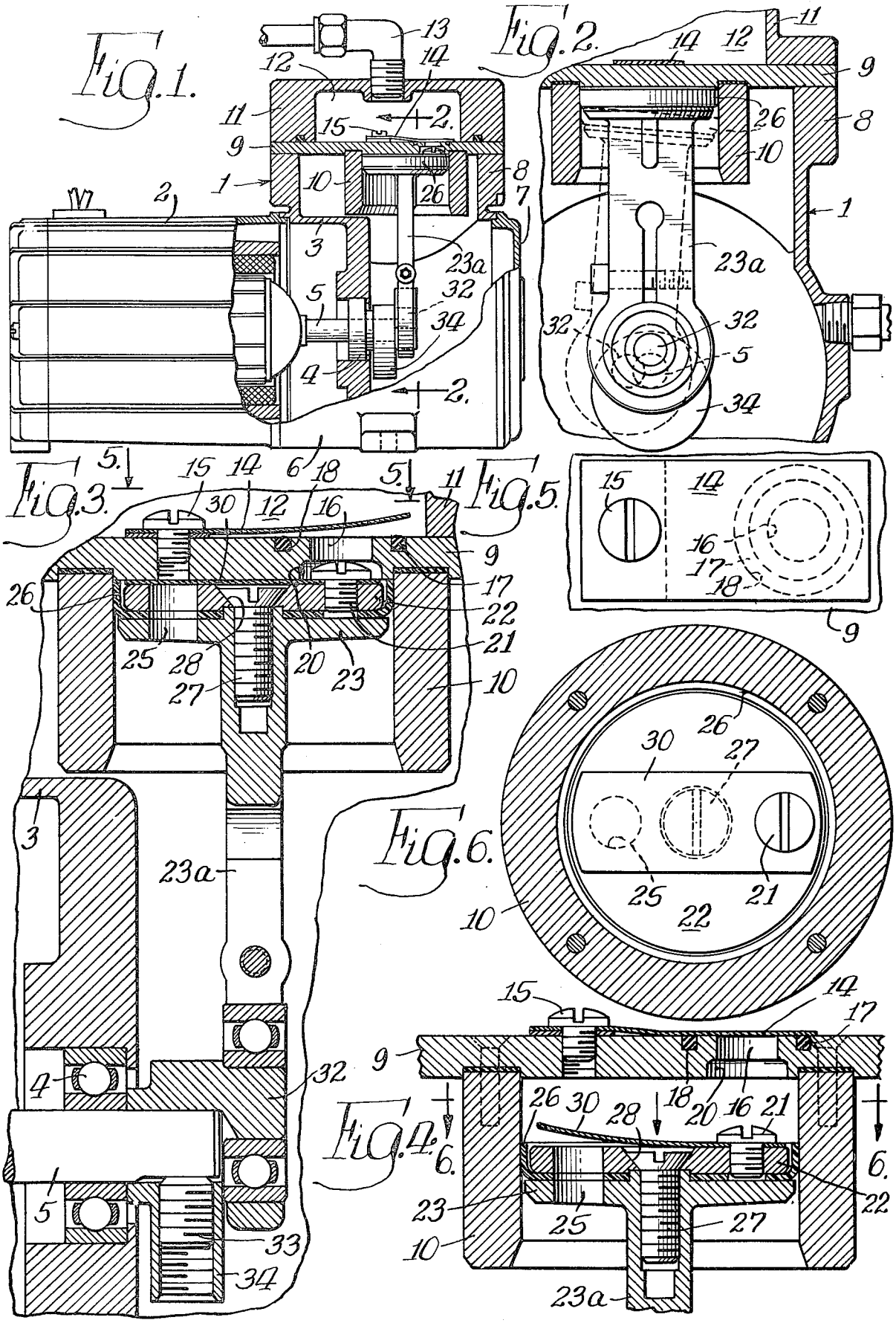
FIG. 1 is a vertical longitudinal section axially of the drive shaft of the compressor which shaft is a continuation of the armature shaft of the driving motor.
FIG. 2 is a vertical transverse section through the compressor shown in FIG. 1 showing taken on the line 2—2 and in dotted lines the tilting of the piston as the crank moves.
FIG. 3 is a vertical section through the axis of the cylinder and the crank shaft showing the piston and connecting rod also in vertical section at the top of the upstroke.
FIG. 4 is a view similar to the upper part of FIG. 3 taken however at a point in the down stroke of the piston.
FIG. 5 is a top plan view on the line 5—5 of FIG. 3 showing the discharge check valve.
FIG. 6 is a horizontal section through the cylinder above the piston and its discharge valve taken on the line 6—6 of FIG. 4.

Referring to FIG. 1, the motor compressor shown in FIG. 1 comprises the main compressor frame 1 and the connected motor frame 2 containing the armature and shaft and ball bearing of the electric motor, preferably but not necessarily, of the direct current type, the frame 2 of the motor being joined to the main frame 1 by the cylindrical bearing frame 3 which contains the ball bearing 4 for the combination motor and compressor shaft 5. Ball bearings or sintered porous oil charged metal bearings are used throughout. The cylindrical lower portion 6 of the main frame 1 is clamped to the motor frame at the left of FIG. 1 and is provided at the right with a cap or cover 7 which is preferably closed but may have a ventilating opening screened to admit atmospheric air to the intake of the compressor. The main frame member 1 comprises an upper generally cylindrical neck 8 carrying the horizontally disposed head plate 9 which on its lower side carries the cylinder 10 to which it is sealed by a gasket, and on its upper side carries an inverted cup 11 which provides the sealed discharge chamber 12 connected with the compressed gas delivery pipe 13. The chamber 12 which receives the gas delivered by the compressor communicates with the inside of the cylinder 10 through the discharge check valve 14. The discharge check valve 14 comprises a thin flexible spring metal strip clamped at its stationary end by the screw 15 and having its free end overlying the cylinder discharge port 16 (see FIG. 3). An O-ring 17, set in a square groove 18, surrounding the discharge passageway 16, at its upper end constitutes the valve seat with which the strip valve 14 cooperates as a check valve to prevent the backward flow of the compressor delivery from the chamber 12 into the cylinder.

The intake from atmosphere inside the crank case to the interior of the cylinder extends through a passageway 25 formed through the piston consisting of the piston plate 23 or base plate, as denoted further herein, the intermediate cup-shaped seal 26 with a through opening, and the clamping plate 22. These parts are clamped together by the central conical headed screw 27 which threads into the upper end of the piston rod 23*a* and has its head seated in the conical central recess 28 formed in the clamping plate 22 which forms the upper one of the pair of plates 22, 23 between which the cup-shaped packing 26 is disposed and clamped.

The head of the screw 27 is countersunk below the top surface of the plate 22 and therefore does not interfere with the operation of the flexible intake check valve 30 which is biased to close off the intake passageway 25 through the piston. It will be observed in FIG. 6 that the head of the screw 21 is received in the clearance recess 20 at the lower end of the discharge passageway 16 thereby minimizing clearance space which contributes the efficiency of the compressor.

The piston packing 26 which is present in the form of a cup-shaped body of synthetic sheet material known as Teflon, which is technically designated as polytetrafluoro-ethylene, is in the general shape of a "cup leather" long known in the pump industry but it has unique qualities which are of great utility in the present invention. It is preferably impregnated during manufacture with a lubricant such as graphite or other like materials having lubricating properties. It will withstand high temperatures without failure. Its qualities are published in technical literature. The sealing cup 26, in the present instance, has its outer rim initially formed in the shape of a flange at an angle of approximately 45° to the body of the disk and when it is introduced into the cylinder it conforms to the cylinder but retains its resiliency and unity and provides a uniform seal around the periphery of the piston. Obviously it may be formed to a greater cup shape than above indicated, but in the final assembly it is disposed substantially as shown in the drawings of this application—namely, that the flange is substantially parallel or slightly flared out throughout the major part of its length with respect to the wall of the enclosing cylinder.

The cylindrical wall 10 is manufactured as a separate unit consisting of wrought or drawn aluminum, the bearing surface on the interior being specially treated to provide a wear resisting coating, which treatment is well known in the metals industries. The preferred treatment is an electrochemical conversion of the aluminum surface to aluminum oxide to produce an abrasion resistant anodic coating. The resulting surface of the treated aluminum cylinder in sliding engagement with the Teflon cup provides a fluid tight seal with low friction.

In operation, the energization of the direct connected motor rotates the shaft 5 upon which the crank pin 32 and counterbalance 34 are clamped as by a set screw 33.

The downstroke of the piston from the position shown in FIGS. 1 and 3 tilts the piston as shown in dotted lines in FIG. 2. The maximum tilt occurs when the crank pin 32 is about halfway down and also halfway on the up stroke. In neither position does the flange unseal the piston in the cylinder. The admission check valve 30 springs open under suction in the cylinder and admits a charge of air which is then trapped by the check valve throughout the entire discharge stroke. No adverse effects from the uneven motion of the piston are detectable.

We claim:

1. In a compressor the combination of a cylinder (10) having a cylindrical interior working wall and a cylinder head (9), a discharge check valve (14) having a passageway (16) through said cylinder head, said valve comprising a thin parallel sided flat strip of spring metal attached at one end to the top side of said cylinder head, a piston (22,23) in said cylinder, said piston having an inlet passageway (25) therethrough and an inlet check valve (30) for said passageway permitting gaseous fluid to flow through the piston inlet passageway into the cylinder from below the piston, a crank shaft (5) having a stationary bearing (4) rigid with the cylinder and having a crank with a crank pin (32), a piston rod (23*a*) rigidly connected at its outer end with the piston and having a free end with a crank bearing journaled on said crank pin (32), said piston comprising a circular base plate (23) rigidly attached to the end of the piston rod (23*a*) remote from the aforesaid crank bearing and an upper circular flat clamping plate (22), a flexible nonmetallic cupped sealing disk (26) of a free diameter greater than the diameter of the bore of the cylinder and having a central flat portion clamped between said circular base plate (23) and said clamping plate (22) and comprising an integral peripheral flange engaging the walls of the cylinder in sliding relation, said cupped nonmetallic flanged disk (26) comprising a thin circular body of Teflon of substantially uniform thickness, the flange of said disk fitting against the walls of the cylinder on both suction stroke and discharge stroke of the piston, said inlet check valve (30) having a passageway connecting the space below the piston with the inside of the cylinder, and the discharge check valve (14) providing a connection from inside the cylinder through the cylinder head, said check valve comprising a thin flat flexible strip of spring metal attached at one end to the cylinder head (9), the flange of said Teflon disk maintaining the metal parts of the piston out of metal-to-metal contact with the cylinder walls during reciprocation of said piston, said circular Clamping plate (22) having a central axial opening countersunk at its upper end, the disk (26) having a central opening in register with the opening of the aforesaid clamping plate 22, the base plate (23) on the upper end of the connecting rod having a threaded screw socket, there being registering central openings through the clamping plate and the disk, a central conical headed clamping screw threaded into said threaded socket far enough to bring its head below the level of the upper surface of the clamping plate (22) for clamping the plate (22), the flexible disk (26) and the end of the connecting rod together, and the discharge valve comprising a thin flat parallel-sided spring held by a clamping screw threaded into the clamping plate (22) over the countersunk screw (27) and over the inlet passageway (25).

* * * * *

UNITED STATES PATENT OFFICE

CERTIFICATE OF CORRECTION

PATENT NO. : 3,961,868

DATED : June 8, 1976

INVENTOR(S) : Arthur John Droege, Sr. & Richard Charles Bell

It is certified that error appears in the above-identified patent and that said Letters Patent are hereby corrected as shown below:

Col. 4, line 51

"discharge" should read --inlet--

Signed and Sealed this

Twelfth Day of April 1977

[SEAL]

*Attest:*

RUTH C. MASON
*Attesting Officer*

C. MARSHALL DANN
*Commissioner of Patents and Trademarks*